US005898397A

United States Patent [19]

Murray

[11] Patent Number: 5,898,397

[45] **Date of Patent: *Apr. 27, 1999**

[54] REMOTE CONTROL TRANSMITTER AND METHOD OF OPERATION

[75] Inventor: James S. Murray, Redford, Mich.

[73] Assignee: Stanley Home Automation, Novi, Mich.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/693,879

[22] Filed: Aug. 5, 1996

Related U.S. Application Data

[63] Continuation-in-part of application No. 08/585,513, Jan. 16, 1996, Pat. No. 5,699,065.

[51] Int. Cl.[6] ..... G08C 19/12

[52] U.S. Cl. ..... 341/176; 341/173; 340/825.24; 340/825.25; 340/825.72; 359/148; 455/6.3; 455/179.1

[58] Field of Search ..... 341/173, 176; 340/825.24, 825.25, 825.56, 825.62, 825.69, 825.72, 825.54, 539; 359/142, 145, 146, 148; 455/6.3, 151.1, 151.2, 179.1

[56] References Cited

U.S. PATENT DOCUMENTS

| | | | |
|---|---|---|---|
| Re. 29,525 | 1/1978 | Willmott | 341/176 |
| 3,582,783 | 6/1971 | Hendrickson | 340/825.69 |
| 3,609,390 | 9/1971 | Feldman | 307/134 |
| 3,716,865 | 2/1973 | Willmott | 340/825.69 |
| 4,037,201 | 7/1977 | Willmott | 340/825.69 |
| 4,385,296 | 5/1983 | Tsubaki et al. | 340/825.72 |
| 4,425,647 | 1/1984 | Collins et al. | 359/146 |
| 4,482,947 | 11/1984 | Zato et al. | 340/825.76 |
| 4,538,661 | 9/1985 | Henry et al. | 160/35 |
| 4,596,985 | 6/1986 | Bongard et al. | 340/825.69 |
| 4,653,565 | 3/1987 | Iha et al. | 160/193 |
| 4,774,511 | 9/1988 | Rumbolt et al. | 340/825.69 |
| 4,806,930 | 2/1989 | Wojciak, Jr. | 340/825.69 |
| 4,855,746 | 8/1989 | Stacy | 341/176 |
| 4,866,434 | 9/1989 | Keenan | 340/825.72 |
| 4,912,463 | 3/1990 | Li | 340/825.69 |
| 4,988,992 | 1/1991 | Heitschel et al. | 340/825.69 |
| 5,278,480 | 1/1994 | Murray | 318/626 |
| 5,331,325 | 7/1994 | Miller | 341/176 |
| 5,438,325 | 8/1995 | Nishigaki et al. | 359/148 |
| 5,550,536 | 8/1996 | Flaxl | 340/825.54 |
| 5,699,065 | 12/1997 | Murray | 341/176 |

*Primary Examiner*—Michael Horabik
*Assistant Examiner*—Timothy Edwards, Jr.
*Attorney, Agent, or Firm*—Young & Basile, PC

[57] ABSTRACT

A remote control transmitter capable of transmitting a coded signal for actuating a device connected to a remote receiver. The remote control transmitter includes a controller which actuates a transmitter element upon each activation of an activation switch. A first code generator generates a first code and a second code generator generates a second code. The controller automatically selects one of the first code and the second code for transmitting within the coded signal. The first and second codes are generated by multi-positionable switches, a serial data device, a code key memory or by rolling code encryption.

15 Claims, 7 Drawing Sheets

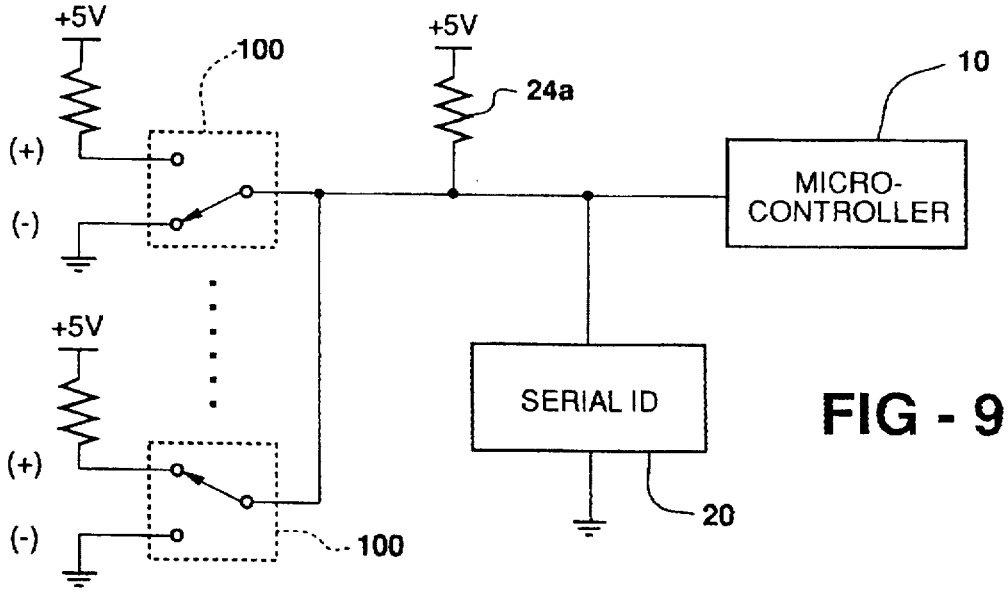
FIG - 9
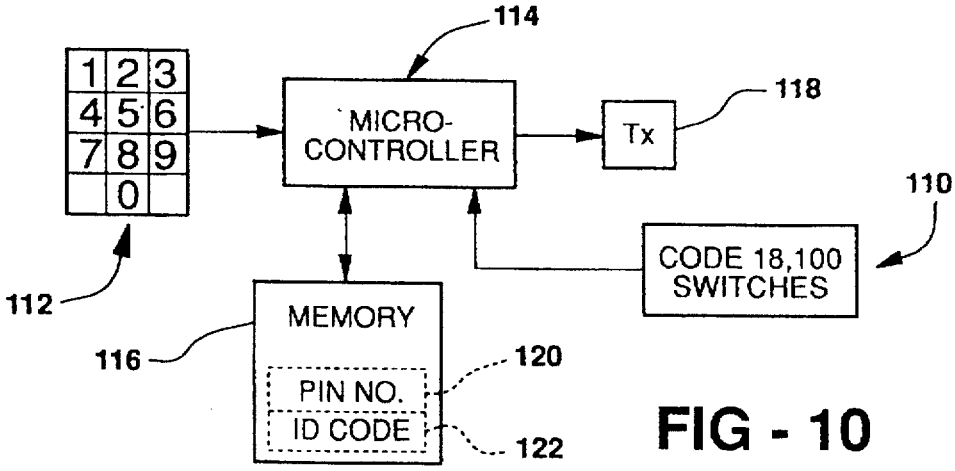
FIG - 10
FIG - 11
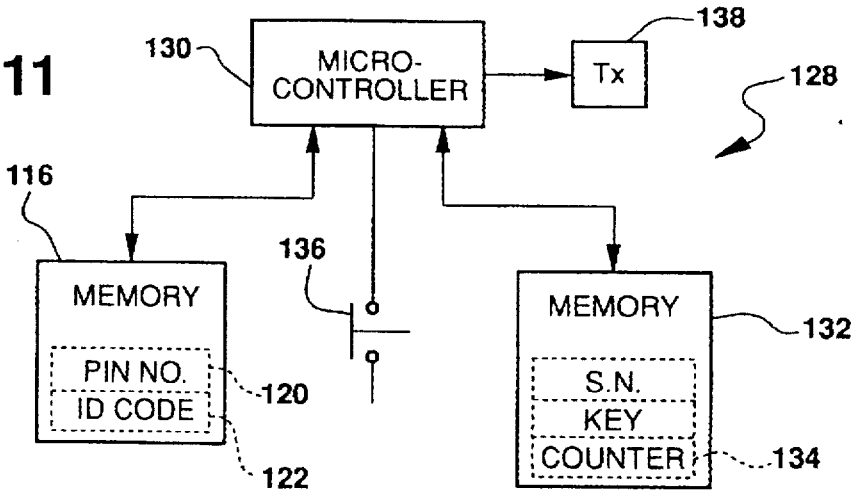

REMOTE CONTROL TRANSMITTER AND METHOD OF OPERATION

CROSS REFERENCE TO CO-PENDING APPLICATION

The present application is a continuation-in-part of application Ser. No. 08/585,513, filed Jan. 16, 1996, now U.S. Pat. No. 5,699,065 in the name of James S. Murray, and entitled "REMOTE CONTROL TRANSMITTER AND METHOD OF OPERATION."

FIELD OF THE INVENTION

The present invention relates to a wireless remote control transmitter capable of automatically transmitting one of two different encoded signals, for activating a remote receiver.

BACKGROUND OF THE INVENTION

Various types of remote control systems are available for use with garage door openers, home automation systems, vehicle locking systems, and the like. A common element found in many remote control systems is the use of an encoded signal transmitted from a transmitter to a remote receiver. The receiver receives the encoded signal, compares the code contained within the signal with a stored code or codes, and activates the remotely controlled device if the received code matches the stored code. If an invalid code is received by the receiver, the remotely controlled device is not activated.

Various systems have been developed to ensure that the encoded signal transmitted by the transmitter is accepted by the receiver. Early systems used a series of switches contained in both the receiver and the transmitter which could be set to any pattern desired by the user. Typically, a series of two-position or three-position slide switches or rocker switches are contained in both the transmitter and the receiver. The user of the remote control system sets the pattern of the switches in both the transmitter and the receiver to be identical. If multiple transmitters are used with a single receiver, the switches in each transmitter are set to the same pattern; i.e., the pattern set in the receiver.

Remote control systems which require the setting of various switches are somewhat tedious, especially for a user who is not mechanically inclined. If the transmitter and receiver are purchased as a single unit, the switches in both devices may be set to match one another at the factory. However, if the units are purchased separately, or if an additional or replacement transmitter is purchased at a later date, the user must set the switches before the system can be used. This requires first determining the switch settings in the existing receiver. Next, the new or replacement transmitter is partially disassembled to access the switches contained within the transmitter. The switches in the transmitter are then set to match those of the receiver, and the transmitter is reassembled.

Another type of remote control system uses a "smart" receiver design which is capable of learning a code contained in a transmitter. Typically, these smart receivers include a memory device capable of storing several different valid codes, thereby allowing use of several different transmitters, each having a different code. Transmitters used with smart systems do not use switches to set the transmitted code, but instead use a permanent electronic serial number. This electronic serial number is unique to each transmitter and cannot be changed by the user.

Smart systems operate by first placing the receiver in a "learn" mode wherein it stores any encoded signal received from a transmitter. Once the receiver is switched to the learn mode, activating a transmitter to be used with the receiver stores that transmitter's code in the receiver's memory. The transmitter is activated in the usual manner, such as by pressing the activation switch. Since the transmitter does not use switches to generate the code, a minimal amount of user interaction is required. User interaction is usually limited to the movement of a single switch on the receiver between a "learn" position and an "operate" position, and activation of the transmitter.

Remote control systems for operating a garage door typically consist of a receiver unit permanently mounted in the garage, adjacent the motor-driven garage door opener. One or more remote transmitters are located in the vehicles which will require access to the particular garage door. Since the transmitter units are small portable devices located within the car, they are susceptible to damage, theft, or misplacement. Therefore, it is common for the receiver to outlive or outlast the portable transmitter. When a portable transmitter is replaced, the user must know which type of receiver unit is located in the garage, and purchase the appropriate transmitter for that receiver system. Furthermore, the merchant who sells remote control systems must maintain a stock of transmitters capable of operating the older, switch-controlled coding systems as well as a stock of newer, smart transmitter devices. Therefore, the merchant must either maintain a supply of two different portable transmitters or neglect customers who own older systems, and carry only the newer smart transmitters.

Similar problems exist with the use of code key transmitters. A code key transmitter is typically a small housing mounted exteriorly of the garage which includes a keypad providing numeric input to a controller or microprocessor. A PIN code is selected by the user and stored in a memory coupled to the microprocessor to validate an open/close signal from a user. Such code key devices transmit a coded signal to a receiver located within the garage after a PIN number input via the keypad has been validated as matching the previously stored PIN number.

The codes in such code key devices have been provided by dip switches or electronic I.D. codes stored in the memory. Such codes, as with remote transmitters, must be programmed to match the code in the receiver. In addition, some code key devices are programmable to match the receiver code. In such devices, the user, when in a program mode, hits the switch numbers from 0 to 9 which are to be set to "1" state. The remaining, unprogrammed switch numbers at a "0" state. This enables the code key device to transmit the serial signal containing the binary code which matches the code in the receiver.

Thus, as with remote transmitters, a merchant must either maintain a supply of two different types of code key devices or neglect customers who own older systems which use dip switches.

SUMMARY OF THE INVENTION

The present invention provides a remote control transmitter which is capable of automatically selecting between two different code generating sources within the transmitter. The first code generating source is used, for example, to operate older, switch-controlled remote control systems. The second code generating source is used, for example, with newer, "smart" remote control systems. According to the present invention, a single transmitter is capable of performing the functions of both the earlier remote control systems as well as the newer systems, thereby eliminating the need to provide two separate types of transmitters. The selection of the proper code generating source is transparent to the user due to automatic code selection by the transmitter.

According to the present invention, the remote control transmitter is capable of transmitting an encoded signal for actuating a device connected to a remote receiver. The remote control transmitter includes an electronic control device for controlling the operation of the transmitter. An activation switch is connected to the electronic control device and is capable of energizing the transmitter. A first code generating device is capable of creating a first code and a second code generating device is capable of creating a second code. The electronic control device contains a system for automatically selecting between the first code and the second code. The selected code will be included within the encoded signal. A transmitting device is connected to the electronic control device and transmits the encoded signal to the remote receiver.

According to another aspect of the present invention, the first code generating device is a plurality of multiple-position switches connected to the electronic control device. The second code generating device is a silicon serial identification device capable of generating a serial stream of data and connected to the electronic control device.

Another feature of the present invention provides that the electronic control device is a microcontroller having a plurality of input connections. A single microcontroller input connection is connected to both the first code generating device and the second code generating device. A plurality of the microcontroller input connections are connected to the first code generating device alone.

According to a further aspect of the inventive transmitter, the means for automatically selecting between the first and second codes determines the position of the plurality of multiple-position switches contained in the first code generating device. The first or second code selected is based on the position of the multiple-position switches.

When selecting the proper code to be included within the encoded signal, the multiple-position switches are compared to a predetermined pattern. If the switches match the predetermined pattern, then the second code is included in the encoded signal. If the switches do not match the predetermined pattern, then the first code is included in the encoded signal.

The teachings of the present invention are also employable with a code key transmitter having a memory storing an input verification or PIN number and a unique code to be transmitted to the receiver when the input PIN number matches a PIN number prestored in the memory. The code may be programmably set via a keypad.

The present invention is also usable with transmitters and receivers utilizing rolling or hopping code encryption. The same selection method described above may be used with such rolling code encryption circuitry to select either a first code from the multi-positionable switches or the code key memory, or a second rolling code.

By utilizing the present invention, various remote control transmitters may be devised which include at least two code generating means for use with various types of receivers containing only one code generating means. This enables a retailer to stock only a single type of transmitter since the single transmitter is usable with receivers having codes set by multi-positionable dip switches, programmable memory devices, or rolling code encryption circuitry.

BRIEF DESCRIPTION OF THE DRAWINGS

FIG. 9 is a partial block diagram of an alternate control transmitter usable in the embodiment shown in FIG. 1 and showing a representative binary switch;

FIG. 10 is a block diagram of a code key transmitter; and

FIG. 11 is a block diagram of a transmitter utilizing code hopping encryption.

DETAILED DESCRIPTION OF THE PREFERRED EMBODIMENT

Figure 1:
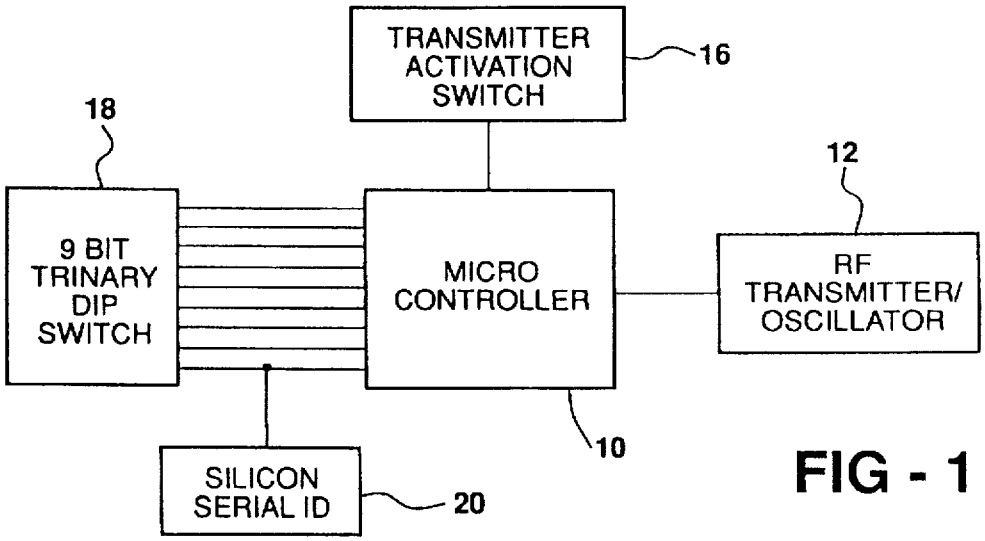
FIG. 1 illustrates a block diagram of a wireless remote control transmitter according to the present invention.

Referring to FIG. 1, a block diagram of the remote control transmitter as used in the present invention is illustrated. The remote control transmitter illustrated in FIG. 1 may be a portable unit located in a vehicle or an underhood unit permanently installed in a vehicle. This type of underhood installation is further described in U.S. Pat. No. 5,140,171, which is incorporated herein by reference. A microcontroller 10 controls the overall operation of the transmitter. Microcontroller 10 (shown schematically in FIG. 4) includes a series of input pins and output pins. An output pin of microcontroller 10 is connected to a radio frequency transmitter/oscillator 12 which transmits an encoded signal to a remote receiver (not shown). The transmitter/oscillator 12 is shown in schematic detail in FIG. 4.

A transmitter activation switch 16 is electrically connected to an input pin of microcontroller 10. When the invention is embodied in a portable transmitter, transmitter switch 16 is a momentary push-button switch providing momentary activation when pressed. When the invention is permanently installed in a vehicle, transmitter switch 16 is incorporated into the vehicle headlight system such that switch 16 shares a function with the high beam control switch, as described in U.S. Pat. No. 5,140,171.

Figure 2:
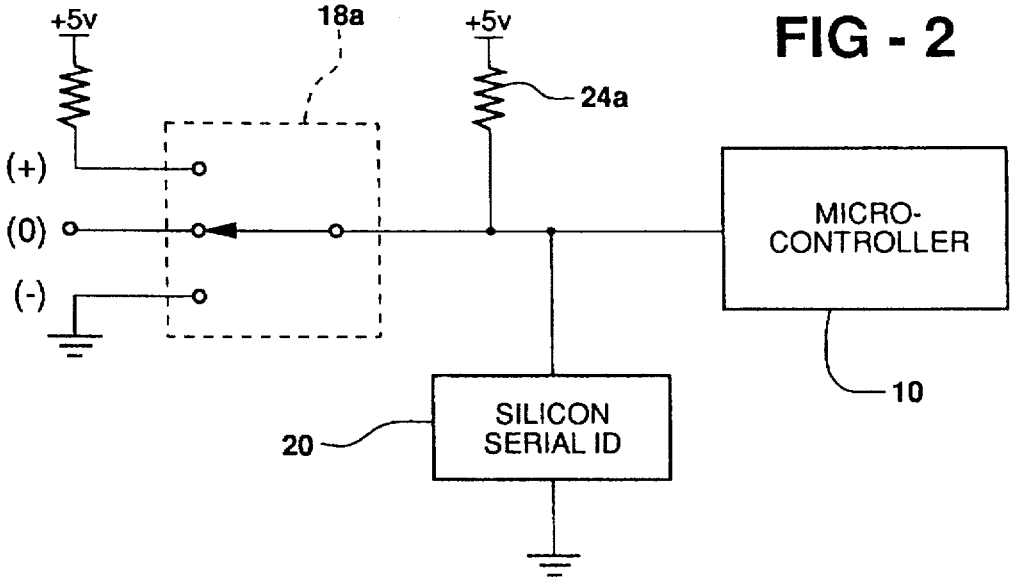
FIG. 2 is a partial block diagram of the remote control transmitter of FIG. 1 illustrating the code generating sources and a representative switch.

A 9-bit trinary DIP switch 18 is connected to nine input pins of microcontroller 10. As shown in FIG. 2, trinary DIP switch 18 contains separate switches 18*a* arranged linearly in a single package. Each of the individual switches 18*a* has three different possible positions: a (+) position, a (−) position, and an open position. A silicon serial ID 20 is connected to a single input pin of microcontroller 10. As shown in FIGS. 1 and 2, serial ID 20 shares an input pin of microcontroller 10 with a single switch 18*a*.

Figure 4:
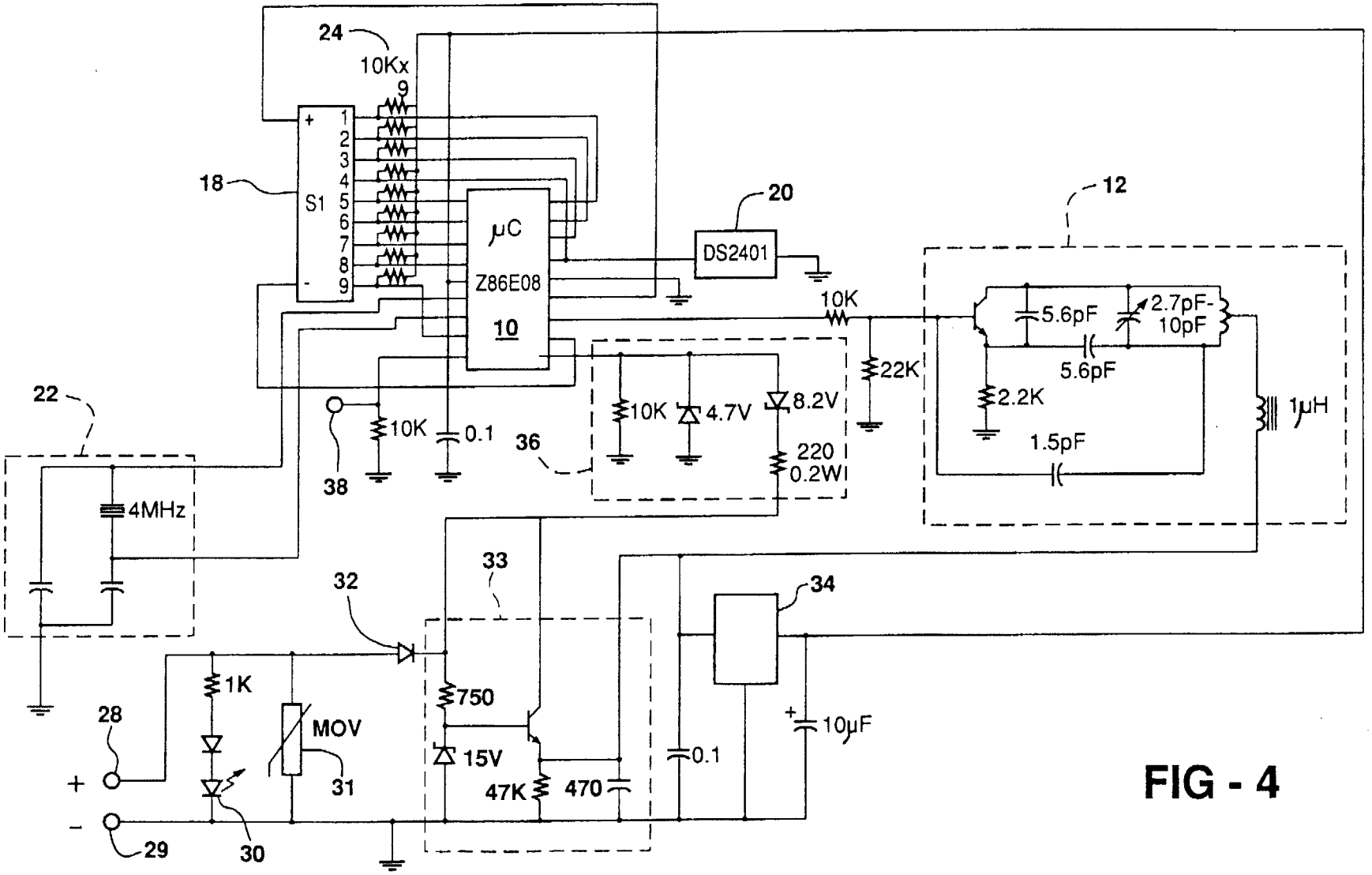
FIG. 4 is a schematic drawing showing the components of the remote control transmitter and their electrical interconnection as used in a permanent vehicle installation.

Referring to FIG. 4, an output side of switch 18 is connected to both the input pins of microcontroller 10 and a resistor network 24. Resistor network 24 is connected to +5 volts and acts as a pull-up resistor for each input pin. An input side of switch 18 has two connection pins labeled (+) and (−), both of which are connected to a pin of microcontroller 10. Each switch 18*a* may be set to one of three different positions ((+), (−), or open). In the (+) position, the switch connects +5 volts to the switch output, and therefore generates a +5 volt signal at the input pin of microcontroller 10. In the open position, the switch is not connected to any other circuit, but remains open. In the (−) position, the switch connects signal ground to the switch output, thereby generating a ground signal at the input pin of microcontroller 10.

As illustrated in FIG. 2, silicon serial ID 20 is electrically connected between one of the trinary DIP switches 18*a* and an input pin of microcontroller 10. Serial ID 20 is preferably a Dallas Semiconductor Model 2401 which produces a serial stream of binary data. Each serial ID 20 contains a unique 48 bit electronic serial number permanently stored in the device. When activated, serial ID 20 generates this unique serial number by providing a serial stream of data to microcontroller 10 through the input pin. The silicon serial ID is only used when switch 18*a* is in the open position; i.e., not connected to either +5 volts or ground. Therefore, the output of serial ID 20 is not in contention with either the (+)5 volt connection or the ground connection.

Figure 3:
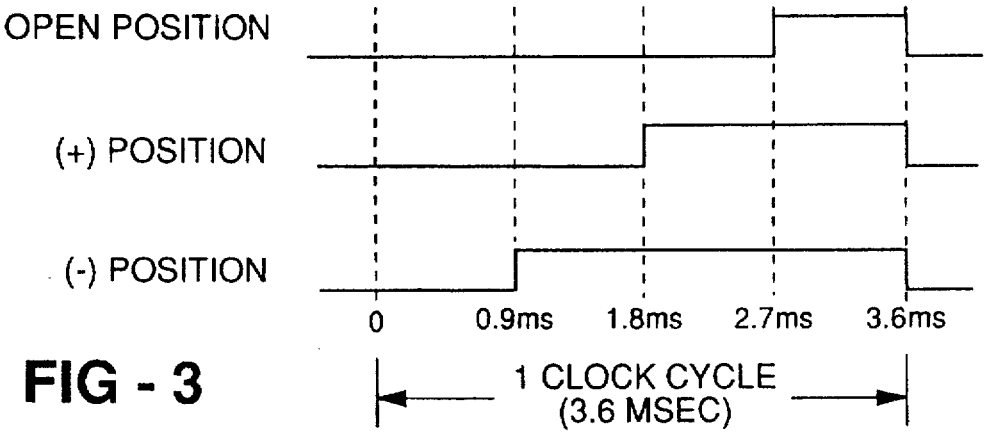
FIG. 3 illustrates the transmission characteristics of the remote control transmitter signal.

FIG. 3 illustrates the transmission format used by the remote control transmitter according to this invention. RF transmitter 12 transmits radio frequency signals using a trinary protocol. Each cycle of the transmission is 3.6 milliseconds in length, as shown in FIG. 3. During the first 0.9 milliseconds of each cycle, the transmission signal is always LO. To transmit a character representing the negative switch position, a HI signal is transmitted during the remainder of the cycle (0.9 milliseconds(−)3.6 milliseconds). If a positive switch setting is to be transmitted, a LO signal is transmitted during the first 1.8 milliseconds, and a HI signal is transmitted during the remaining 1.8 milliseconds. Finally, if the open switch position is selected, the first 2.7 milliseconds are transmitted as a LO signal and the remaining 0.9 milliseconds as a HI signal.

The three different signal types illustrated in FIG. 3 correspond with the three different switch positions available for switch 18*a*. Similarly, although serial ID 20 creates a binary data stream, its serial number is converted to base 3 and transmitted as a trinary data stream, using the format illustrated in FIG. 3.

An alternate embodiment of the switch 18 is shown in FIG. 9. In this embodiment, the switch 18 is formed of a plurality of binary switches each denoted by reference number 100. Each binary switch 100 has two different possible positions, i.e., a (+) position and a (−) position. The (+) terminal is connected to +5 volts; while the (−) terminal is connected to ground. In this manner, movement of the switch actuator between the two positions generates a (+) or (−) signal (i.e., a "1" or a "0") as an input to the microcontroller 10.

It will be understood that any number of binary switches 100 may be employed to provide any bit length input to the microcontroller 10. By example only, a 10 bit binary input from the binary switches 100 is used in the following description.

Referring to FIG. 4, a schematic diagram of the remote control transmitter is shown as used in a permanent vehicle installation. Microcontroller 10 shown in FIG. 4 is manufactured by Zilog as part number Z86E08 (one-time programmable version) or Z86C08 (masked version). The masked version contains a custom program for use with a specific application.

Terminals 28 and 29 are connected to the vehicle's high beam circuitry, as described in U.S. Pat. No. 5,140,171. Terminals 28 and 29 provide power to the transmitter as well as an activation signal produced by the high beam switch. A light emitting diode 30 indicates whether power is being supplied to the transmitter circuit.

A Metal Oxide Varistor 31 is connected across terminals 28 and 29 to dissipate voltage surges and spikes, thereby protecting the remaining circuitry from damage. A diode 32 also protects the circuit from damage by preventing reverse currents which may occur when jump-starting the vehicle.

The circuit identified by block 33 provides power to RF transmitter/oscillator circuit 12. A voltage regulator 34 produces a +5 volt power supply for the digital components requiring such a supply voltage. The circuit identified by block 36 functions to create a trigger signal for microcontroller 10 and clamps the voltage at 4.7 volts. A test point 38 provides an alternate trigger point for activating microcontroller 10 during assembly or diagnostic testing.

RF transmitter/oscillator circuit 12 is connected to an output pin of microcontroller 10 and generates a radio frequency signal transmitted to the remote receiver. An oscillator circuit 22 supplies a necessary clock signal to microcontroller 10.

The (+) and (−) pins of switch 18 are connected to microcontroller 10, thus permitting the microcontroller to control the voltage level applied to the pins of the switch. This control is necessary to determine the position of each individual switch 18*a*, as described below.

Figure 5:
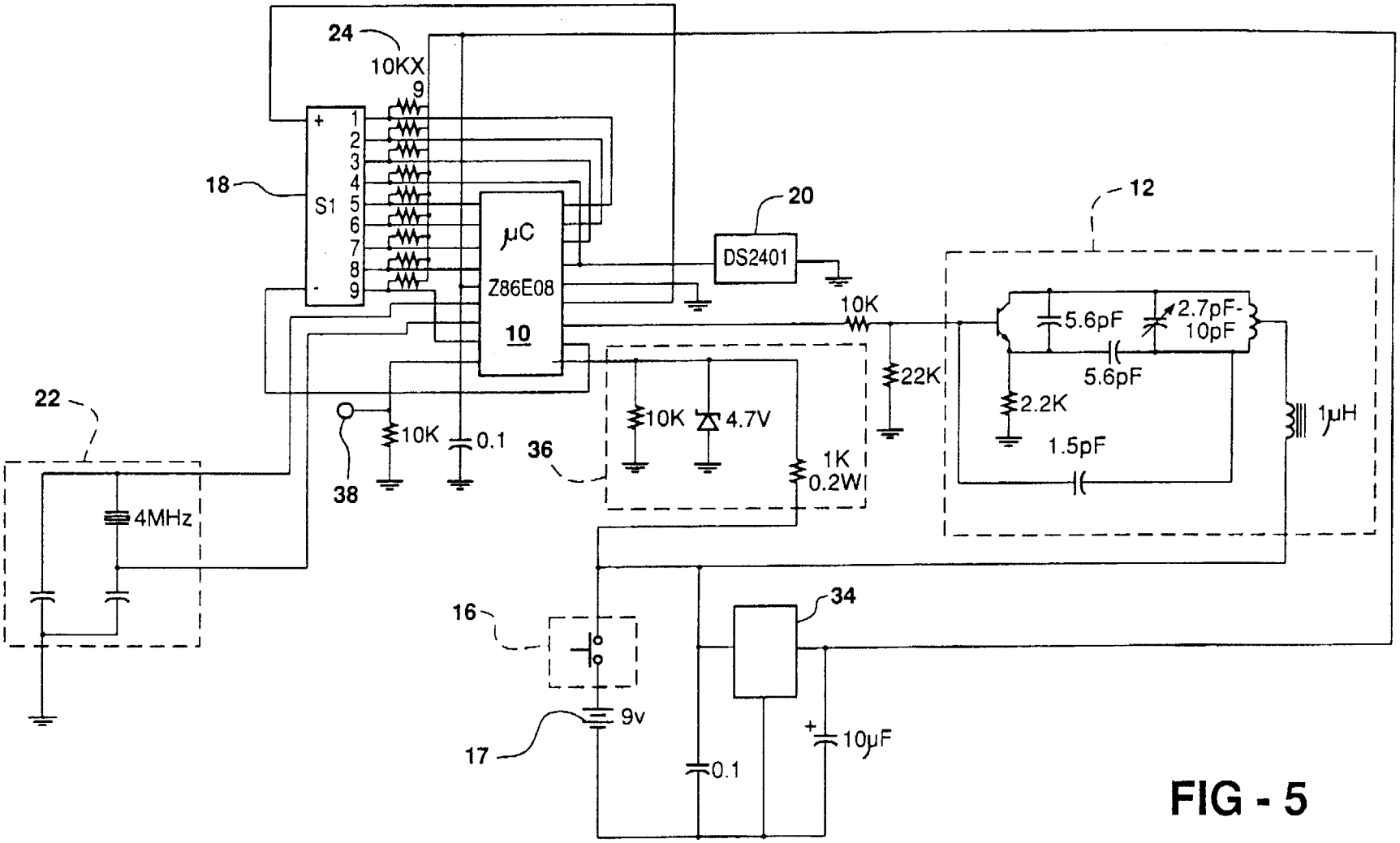
FIG. 5 is a schematic drawing showing the electrical interconnection of the remote control transmitter components as used in a portable transmitter.

FIG. 5 illustrates a schematic drawing for the circuit as used in a portable transmitter. The schematic in FIG. 5 is similar to FIG. 4, with common components being referenced with common reference numerals. Switch 16 is a momentary push button switch which activates the transmitter circuit when actuated.

A 9 volt battery 17 is connected in series with switch 16 to provide power to the transmitter circuit when the switch is actuated. The remaining components shown in FIG. 5 are connected as described with reference to FIG. 4, and function in the same manner.

In operation, the transmitter is activated when the transmitter switch is actuated. The transmitter switch may be a push button switch as used with the portable transmitter or a high beam switch as used in a permanent vehicle installation. Regardless of the transmitter switch used, once the transmitter is activated, it operates in a single manner.

Figure 6:
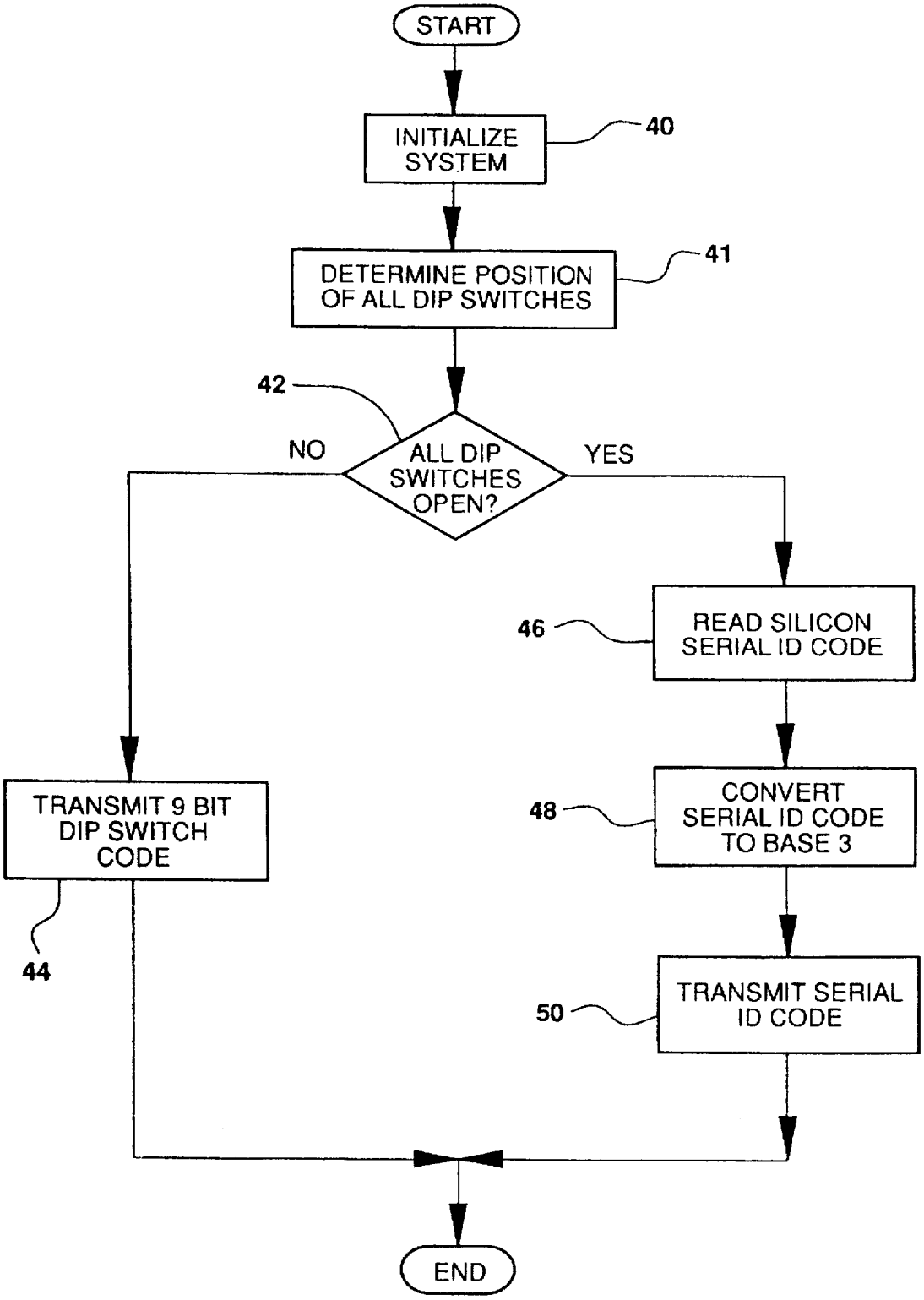
FIG. 6 is a flow chart illustrating the procedure for automatically selecting the code generating source.

As illustrated in FIG. 6, the microcontroller is initialized at step 40 as a first step in transmitting the proper encoded signal. After initialization, the transmitter checks the position of all nine trinary switches 18 at step 41. At step 42, the microcontroller specifically checks each switch 18*a* to determine whether the switch is in the open position. Additional details regarding step 42 are described later with reference to FIG. 7.

If microcontroller 10 determines that at least one of the nine trinary switches 18 is not in the open position, then the program routine branches to step 44 where the microcontroller uses the 9-bit code generated by trinary switch 18 to encode the transmitted signal. Thus, when any one or more trinary switches 18 is in the positive or negative position, the 9-bit trinary switch code is used to generate the encoded signal.

Step 41 in which the position of all the dip switches is determined as well as step 42 in which a determination is made as to whether all of the dip switches are open also applies to the binary switch 100 shown in FIG. 9. In addition, when the binary switch 100 is used, step 44 is in the transmission of the multi-bit dip switch code generated by the plurality of binary switches 100.

It will also be understood that step 42 which determines whether all of the dip switches are open, by way of example only, uses the open position of all of the dip switches as an indication to use the serial I.D. code. Any other code, i.e., all 1's or any sequence of 1's and 0's, for the dip switches 18*a* or 100 may be employed to automatically select the serial I.D. code.

If microcontroller 10 determines that all nine of the trinary switches 18*a* or all of the binary switches 100 are in the open position, then serial ID 20 will be used to generate the encoded signal. In this case, the routine branches to step 46 where microcontroller 10 reads the code contained in serial ID 20. Next, at step 48, the serial number read from serial ID 20 is converted from a binary sequence to a base 3 sequence. Finally, in step 50, the encoded signal containing the serial ID code, as converted to base 3, is transmitted. Step 48 will be eliminated when the binary switch 100 is used since the serial I.D. code will normally be stored in binary or base 2 which does not require any conversion to a different base numeric system.

Figure 7:
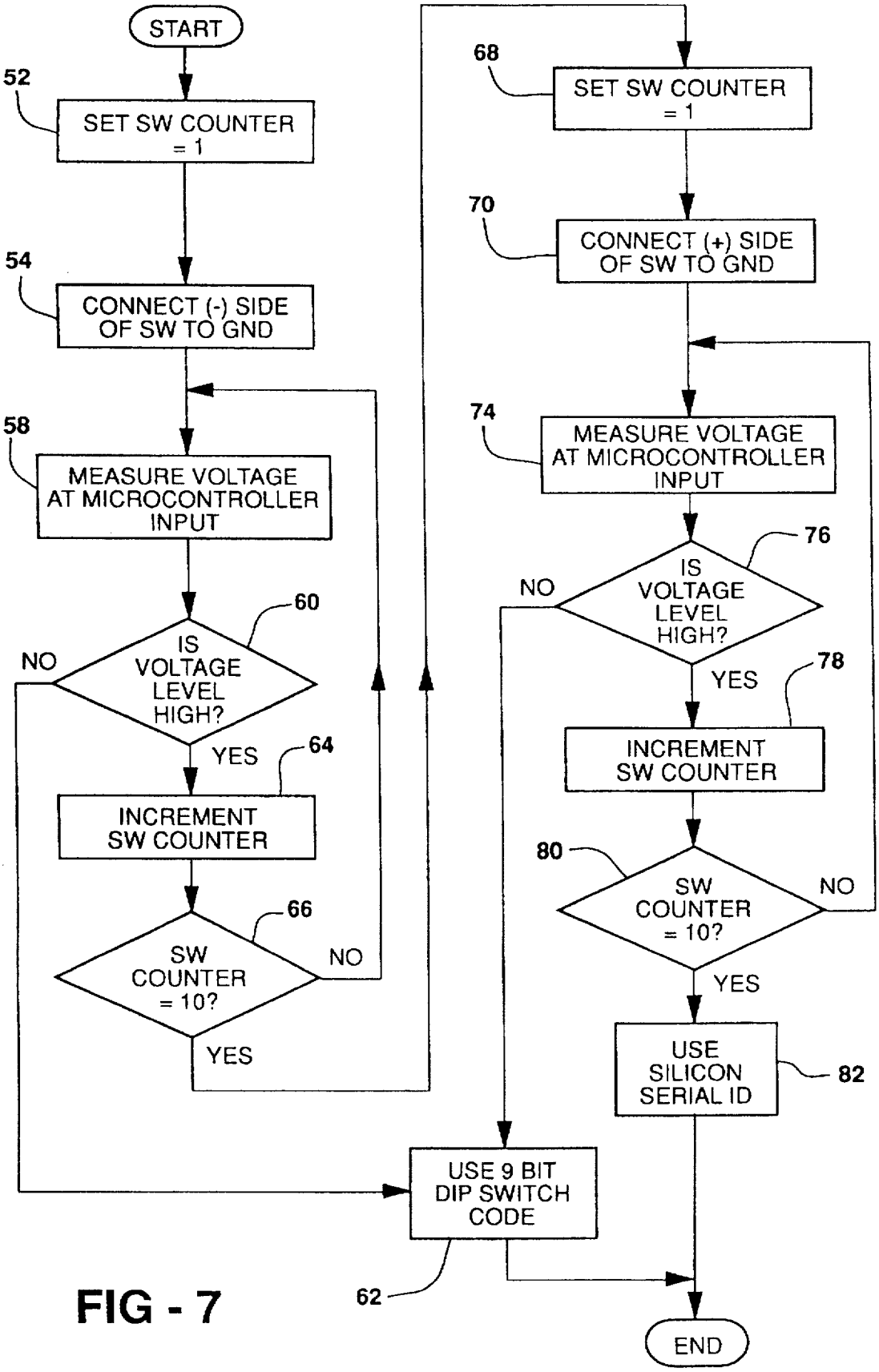
FIG. 7 is a flow chart detailing the method used to determine which code sources is selected.

FIG. 7 illustrates a flow chart describing the method used by microcontroller 10 to determine whether all trinary switches 18 are in the open position. At step 52, a switch counter is set to 1; the switch counter represents the number of the switch currently being analyzed. In step 54, the negative side of switch 18 currently being analyzed is connected to ground. At step 58, microcontroller 10 measures the input voltage at the microcontroller.

At step 60, if the voltage level measured is not high, this indicates that the switch being analyzed is connected to ground, as the only path to dissipate the current. Therefore, the switch is not set to the open position, and the 9-bit trinary code or the 10-bit binary code is selected at step 62. If the voltage level measured at step 60 is high, then the switch must be in the open position.

At step 64, the switch counter is incremented, and at step 66 the switch counter is tested for a value of 10. If the switch counter does not equal 10, then all of the switches have not yet been tested, and the routine branches to step 58 and repeats step 60. If any voltage level is not high at step 60, the microcontroller selects the 9-bit DIP switch code.

In step 66, if switch counter equals 10, then the program continues to step 68 where the switch counter is reset to 1 and then to step 70 where the positive side of the trinary or binary switch being analyzed is connected to ground. At step 74 microcontroller 10 measures the voltage at its input. At step 76, microcontroller 10 determines whether the measured voltage is high. If the measured voltage is low, this indicates that the switch position is in the + position rather than in the open position and the routine branches to step 62, where the 9-bit trinary code or the 10-bit binary code is selected for the encoded signal.

If the voltage level measured at step 74 is high, then the switch counter is incremented at step 78, and tested for a value of 10 at step 80. If the switch counter does not equal 10, then the routine branches back to step 74 and repeats step 76. At step 80, if switch counter equals 10, then all of the switches have been determined to be in the open position. In this case, step 82 is executed, and the electronic serial number contained in silicon serial ID 20 is selected for the encoded signal.

As illustrated in FIG. 7, microcontroller 10 determines whether each of the nine trinary switches 18 are in the open position by process of elimination. First, each switch is tested to determine whether it is set in the negative position. Next, all switches are tested to determine whether they are set in the positive position. Only after determining that no switches are in the negative position and no switches are in the positive position, does the microcontroller conclude that all switches are in the open position. As stated earlier, switches 18 provide a trinary signal to the microcontroller. However, since microcontroller 10 is a binary device, the trinary code produced by switch 18 must be converted to a binary code for processing by the microcontroller. Since serial ID 20 provides a binary data stream to microcontroller 10, no conversion is necessary to process the binary data stream.

Figure 8:
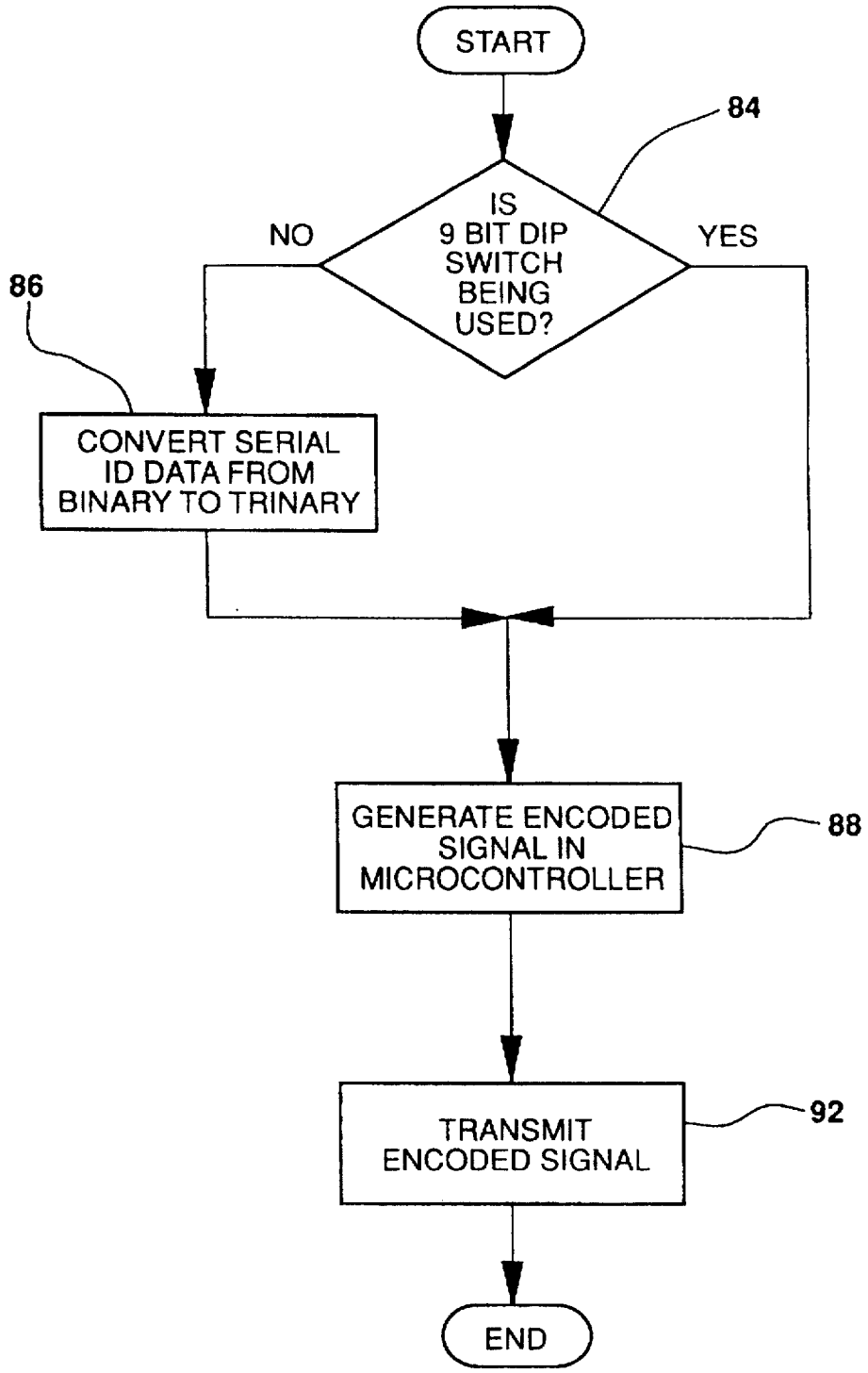
FIG. 8 is a flow chart showing the method used to generate the transmitted signal.

Referring to FIG. 8, a flow chart illustrates the procedure followed by microcontroller 10 when receiving the coded information, and converting it, as necessary. In step 84, the microcontroller 10 determines whether or not the 9-bit trinary code provided by switch 18 is the code selected to be used by the transmitter (this determination is made at step 62 in FIG. 7). If the 9-bit trinary data is to be used, the routine branches to step 88. If the 9-bit trinary data is not used; i.e., the silicon serial number is used, then the routine branches to step 86 and converts the binary serial ID to a trinary value, then to step 88 and generates the data stream to be transmitted by the RF transmitter which will include the selected code. The data stream generated by the microcontroller includes all necessary start bits and stop bits occurring before and after the coded data, respectively.

Alternately, when the 10-bit binary switch 100 is used, step 86 is not needed since the serial I.D. data or code will normally be stored in binary thereby eliminating the need to convert the serial I.D. data to a different base or form.

Finally, at step 92, microcontroller 10 transmits the trinary data stream using RF transmitter 12. The actual wave form patterns to be transmitted are illustrated in FIG. 3, and discussed above.

The above operations are performed each time transmitter switch 16 is activated. Therefore, microcontroller 10 verifies the position of switch 18 or switch 100 upon each activation. If the user of the transmitter has changed any of the switch settings, microcontroller 10 will respond accordingly upon the next activation of switch 16. Thus, the user need not indicate to the remote control transmitter that any changes have taken place; any changes are identified automatically during the next activation cycle.

Referring now to FIG. 10, there is depicted a conventional code key transmitter which also employs the teachings of the present invention. As is conventional, a typical code key transmitter 110 includes a numeric input keyboard or keypad 112 which supplies inputs to a microcontroller 114. The microcontroller 114 executes a control program stored in a memory 116 and, under certain conditions described hereafter, generates an output signal to a transmitter element 118 which transmits an encoded signal to a receiver.

The code key transmitter 110 is designed to learn and store a unique PIN number 120 selected by a user. The PIN number 120 may contain any number of numeric digits selected by the user and input through the keypad 112 to the microcontroller 114 which stores the PIN number 120 in the memory 116. Each time a new PIN number is entered through the keypad 112, the microcontroller 114 compares the new input PIN number with the prestored PIN. number 120. When a match occurs, the microcontroller 114 causes an I.D. code 122, also stored in the memory 116, to be transmitted by the transmitter element 118 to the receiver.

The I.D. code 122 may be similar to the serial I.D. 20 described above. This electronic code must match the code in the receiver. Alternately, if a smart receiver is employed, the smart receiver may learn the I.D. code 122 stored in the code key transmitter 110 in the same manner as described above for other types of smart receivers. Of course, older code key devices could have the I.D. code 122 implemented by means of dip switches in the same manner as switches 18 and 100 described above.

Thus, the code key transmitter 110 may be provided with the programmable I.D. code 122 as shown in FIG. 10 in combination with another code generator, such as the binary switches 100 or the trinary switches 18. The microcontroller 114 executes the same sequence described above to select between either of the first and second codes generated by the switches 100 or 18 and the prestored, programmable I.D. code 122.

It should also be noted that the I.D. code 122 may be electronically programmed via the keypad 112. This requires that the user first determine the code in the receiver. In programming the I.D. code 122, the user, when in the appropriate program mode, sequentially depresses the numbered keys on the keypad 112 corresponding to the switches which are in a "1" state. Microcontroller 114 converts the input signals from the keypad 112 to appropriate address locations in the memory 116 to store the specified bit sequence for the I.D. code 122.

In addition to code key transmitters having a prestored I.D. code 122, a programmable I.D. code or an I.D. code set by discrete switches, a code key transmitter may also utilize rolling code or code hopping encryption as shown in FIG. 11. In such a remote keyless entry system, a microcontroller 130 communicates with a memory 132 which stores a unique transmitter serial number, a unique manufacturer key and a counter value 134. When activated by a user manipulatable switch 136, the microcontroller 130, as is conventional, executes a proprietary, non-linear algorithm utilizing the serial number, the manufacturer key and the counter value to generate an output signal which is transmitted by a transmitter element 138 to the receiver. The transmitter counter advances incrementally upon each activation of the transmitter switch 136.

Similarly, the receiver includes a counter which increments once for each valid transmitter signal that is received by the receiver. The receiver also executes a non-linear algorithm to decode the transmitted signal to reconstruct the transmitter counter value, the manufacturer key, and the serial number transmitted from the rolling code transmitter 128. When the serial numbers match and the transmitter counter values are identical or within a prescribed, allowable numeric range, the receiver will generate an output signal to a control device to open a garage door, vehicle door lock, etc.

Thus, according to the present invention, a remote transmitter is provided which contains rolling code elements as well as a prestored or programmable I.D. code element 122 shown in FIG. 10. The selection between the serial I.D. 20 and the switches 18 or 100 described above also applies to this alternate transmitter configuration except that the selection is between the I.D. code 122 and the rolling code stored in the memory. If any bit of the I.D. code 122 is high or a "1", for example, the I.D. code 122 will be selected as the code for the signal transmitted from the transmitter to the receiver. Alternately, when all bits of the I.D. code are "0", the rolling code elements shown in FIG. 11 will be used to generate the transmitted signal.

Although the operation of the remote control transmitter has been described with respect to a portable transmitter, it will be understood that the same methods and procedures may be used to operate the remote control transmitter if incorporated into the vehicle's high beam switch or otherwise permanently mounted to the vehicle.

Furthermore, the present invention has been described with respect to a remote control transmitter used with a garage door operating system. However, the inventive transmitter is equally applicable to any situation where two or more code generation systems are required, and automatic selection between the systems is desired.

Although a particular microcontroller has been shown and described, it will be understood that other microcontrollers may be used to practice the present invention. Other silicon serial I.D.s may also be used.

The present invention may also utilize other transmission formats such as infrared, audio, etc.

What is claimed is:

1. A remote control transmitter and a remote receiver, the transmitter comprising:

means for transmitting a coded signal to a remote receiver;

control means for controlling the operation of the transmitting means;

means for activating the control means;

a first code generator electrically coupled to the control means and generating a first code for the coded signal;

a second code generator electrically coupled to the control means and generating a second code for said coded signal; and the control means including means for automatically selecting between said first and second codes including means for comparing the first code with a third predetermined code, and selecting one of the first and second codes based on the comparison for exclusively transmitting the selected one of the first and second codes within the coded signal upon each activation of the control means.

2. The remote control transmitter of claim 1 wherein the first code generator is a plurality of multiple-position switches electrically coupled to the control means.

3. The remote control transmitter of claim 1 wherein the second code generator is a serial identification storage device capable of storing and generating a serial stream of data, the serial identification storage device electrically coupled to the control means.

4. The remote control transmitter of claim 1 wherein the control means is a microcontroller having a plurality of input connections electrically coupled to the first code generator and the second code generator.

5. The remote control transmitter of claim 1 wherein:

the first code generator is a serial identification storing device capable of storing and generating a serial stream of data containing the first code, the serial identification storing device electrically coupled to the control means;

the second code generator includes a processor executing a stored control program for generating a signal containing the second code formed of a first variable data bit sequence unique to each signal transmission and a second constant serial data bit stream including a number unique to the transmitter, and the variable data bit stream changing on each subsequent activation of the processor; and the automatically selecting means selecting one of the first and second codes of the first and second code generators upon each activation of the control means.

6. The remote control transmitter of claim 1 wherein the means for automatically selecting between the first and second codes comprises means capable of determining the position of a plurality of multiple-position switches contained in the first code generator, the one of the first and second codes to be selected based on the position of the multiple-position switches.

7. The remote control transmitter of claim 6 wherein the second code is selected for the coded signal if the plurality of multiple-position switches contained in the first code generator match a predetermined stored pattern, and the first code is selected for the coded signal if the plurality of multiple-position switches fail to match the predetermined pattern.

8. The remote control transmitter of claim 1 wherein:

the second code generator comprises means for storing a multi-bit second code.

9. The remote control transmitter of claim 8 further comprising:

input means for entering the multi-bit second code into a data storage device.

10. A method of automatically selecting between a first code and a second code to be transmitted in a coded signal from a remote control transmitter, the coded signal capable of actuating a device connected to a remote receiver, the method comprising the steps of:

a) reading a first code provided by a first code generating device;

b) comparing the first code to a predetermined pattern and determining whether the first code matches said predetermined pattern;

c) selecting the first code to be transmitted if the first code fails to match the predetermined pattern;

d) selecting a second code to be transmitted if the first code matches the predetermined pattern; and e) transmitting the coded signal containing the selected one of the first code and the second code from the remote control transmitter.

11. The method of claim 10 further comprising the step of:

generating the first code from a plurality of settable, multi-positionable, serially arranged switches.

12. The method of claim 10 further comprising the step of:

generating the second code from a serial identification storage device.

13. The method of claim 10 further comprising the step of:

generating the second code containing a first variable data bit sequence unique to each signal transmission and a second constant serial data bit stream including a number unique to the transmitter, the variable data bit stream changing on each subsequent activation of the processor.

14. The method of claim 10 further comprising the step of:

generating the second code from a programmable memory device storing an input verification number and the second code.

15. The method of claim 14 further comprising the step of:

programming the second code into the memory.

* * * * *